United States Patent [19]

Sasao

[11] Patent Number: 4,520,905

[45] Date of Patent: Jun. 4, 1985

[54] ELEVATOR GROUP CONTROL APPARATUS

[75] Inventor: Isao Sasao, Aichi, Japan

[73] Assignee: Mitsubishi Denki Kabushiki Kaisha, Tokyo, Japan

[21] Appl. No.: 587,784

[22] Filed: Mar. 9, 1984

[30] Foreign Application Priority Data

Mar. 9, 1983 [JP] Japan ..... 58-39623

[51] Int. Cl.[3] ..... B66B 1/18

[52] U.S. Cl. ..... 187/29 R; 340/20

[58] Field of Search ..... 187/29; 340/19-21

[56] References Cited

U.S. PATENT DOCUMENTS 4,431,086 2/1984 Moser et al. ..... 187/29 R

*Primary Examiner*—William M. Shoop
*Assistant Examiner*—W. E. Duncanson, Jr.
*Attorney, Agent, or Firm*—Sughrue, Mion, Zinn, Macpeak & Seas

[57] ABSTRACT

In an elevator group control apparatus in which a call by an elevator area call button is assigned to a cage to bring the cage to the user's floor, a second call device is provided separately from the call button. A desired time required for response by cage is designated by the second hall call device, the desired time is compared with an estimated time required for the arrival of car, and a cage is thereby selected to respond to the call. Thus, a cage is caused to serve a user with a minimum time delay.

12 Claims, 5 Drawing Figures

ELEVATOR GROUP CONTROL APPARATUS

BACKGROUND OF THE INVENTION

The present invention relates to an elevator group control apparatus for controlling a group of elevators provided side by side in an building.

In the conventional elevator group control apparatus, for example as disclosed in U.S. Pat. No. 4,244,450, when a floor call is registered, a suitable one of the available elevator cars or cages is assigned to the floor call so that the call can be responded to rapidly. The cages are assigned such that the passengers' average waiting time is minimized and so as not to produce an extreme difference in waiting times for users on different floors.

FIG. 1 shows a conventional elevator group control apparatus for two elevators A and B. In the drawing, 1A designates a hoist of elevator A provided in a machinery room 2; 1B, a similar hoist of elevator B; 3A, a cage of elevator A connected to one end of a cable 4A and supported by the hoist 1A; 3B, a cage of elevator B connected to one end of a cable 4B and supported by the hoist 1B; 5A, a balance weight of elevator A hung at the other end of the cable 4B; 5B, a balance weight of elevator B hung at the other end of the cable 4B; 6A a weighing apparatus for elevator A which produces a passenger-number signal 6A*a* based on the live load in the cage 3A; 6B, a similar weighing apparatus for elevator B which produces a passenger-number signal 6B*a;* 71 through 73, first through third floors, respectively; 81 through 83, call buttons provided at the first through third floors, respectively, beside the elevator doors at those floors in the connectional manner; 9A, a control circuit for elevator A for controlling the hoist 1A to cause the cage 3A to move up and down; 9B, a control circuit for elevator B for controlling the hoist 1B to cause the cage 3B to move up and down; and 10, an assignment computing circuit, having a function equivalent to that shown in FIG. 4 of U.S. Pat. No. 4,244,450, provided for computing the estimated time required for each elevator cage to arrive at the floor at which a call has been registered on the basis of the passenger-number signals 6A and 6B, information signals 9A*a* and 9B*a* of elevators A and B produced by the control circuits 9A and 9B, respectively, and including information as to cage positions, cage calls, running directions, etc., and information stored in assignment memories 11A and 11B, whereby the optimum one of the elevator cages (usually, the elevator cage which can respond to the hall call the earliest) is assigned to the call, with the assignment computing circuit 10 being provided commonly to the elevators A and B. The assignment memory 11A of elevator A serves to store calls assigned to the elevator A by the computing circuit 10 and produces a signal 11A*a* indicative of such calls which is transmitted to the control circuit 9A. The assignment memory 11B of elevator B similarly produces a signal 11B*a*.

Upon the actuation of one of the call buttons 83 in the elevator group control system arranged as described above, the call is inputted to the assignment computing circuit 10. In the assignment computing circuit 10, the estimated time required for each of the cages 3A and 3B to arrive at the floor 72 from which the call was received is computed. If it is determined that the estimated time for the cage 3A, for example, is the shorter, the call signal of the call button 82 is stored in the assignment memory 11A. The control circuit 9A causes the cage 3A to serve the floor 72 corresponding to the call signal stored in the assignment memory 11A.

In the case, for example, where a guest in a hotel wishes to use the elevator system, an indication of his need for an elevator can be transmitted to the elevator system only upon his or her arrival at the elevator area from his guest room, and hence it is necessary to wait for the arrival of an elevator cage from the point of time of call button depression at the elevator area. That is, since the transmission of the need for an elevator is delayed from the time the guest leaves his or her room until arrival at the elevator area, the overall waiting time may be lengthy, and a user particularly in a hurry may become impatient. To resolve this problem, although it may be considered to provide a call button in each guest room, there is a further problem in this case that a cage may arrive at the guest's floor so early that the doors of the case close and the cage leaves before the user arrives. In such a case, although it would be possible to cause the cage to wait for the user, the resulting prolonged wait of the cage at the guest's floor may lower the overall efficiency of the elevator system and result in a prolongation of the waiting time of other users.

SUMMARY OF THE INVENTION

The present invention has been attained in view of the disadvantages described above. Specifically, the present invention provides an elevator group control apparatus for assigning floor calls received from call buttons to individual elevator cages, in which a second call device is provided in addition to the usual floor call button, a desired time for each cage to respond to the call is designated by the second hall call device, the desired time and an estimated time for each cage to arrive at the floor from which the call was received are compared with each other, and one of the cages is selected to serve the call on the basis of the result of this comparison, whereby the call is serviced within the time desired by a user and the user's waiting time is accordingly reduced.

BRIEF DESCRIPTION OF THE DRAWINGS

FIGS. 2 through 4 show a preferred embodiment of the present invention of which, FIG. 2 is a block diagram corresponding to FIG. 1, FIG. 3 a block diagram showing the details of a guest-room call registering device shown in FIG. 2, and FIG. 4 in a circuit block diagram showing the details of a part of an assignment reservation computing circuit of FIG. 2.

DESCRIPTION OF THE PREFERRED EMBODIMENTS

Figure 2:
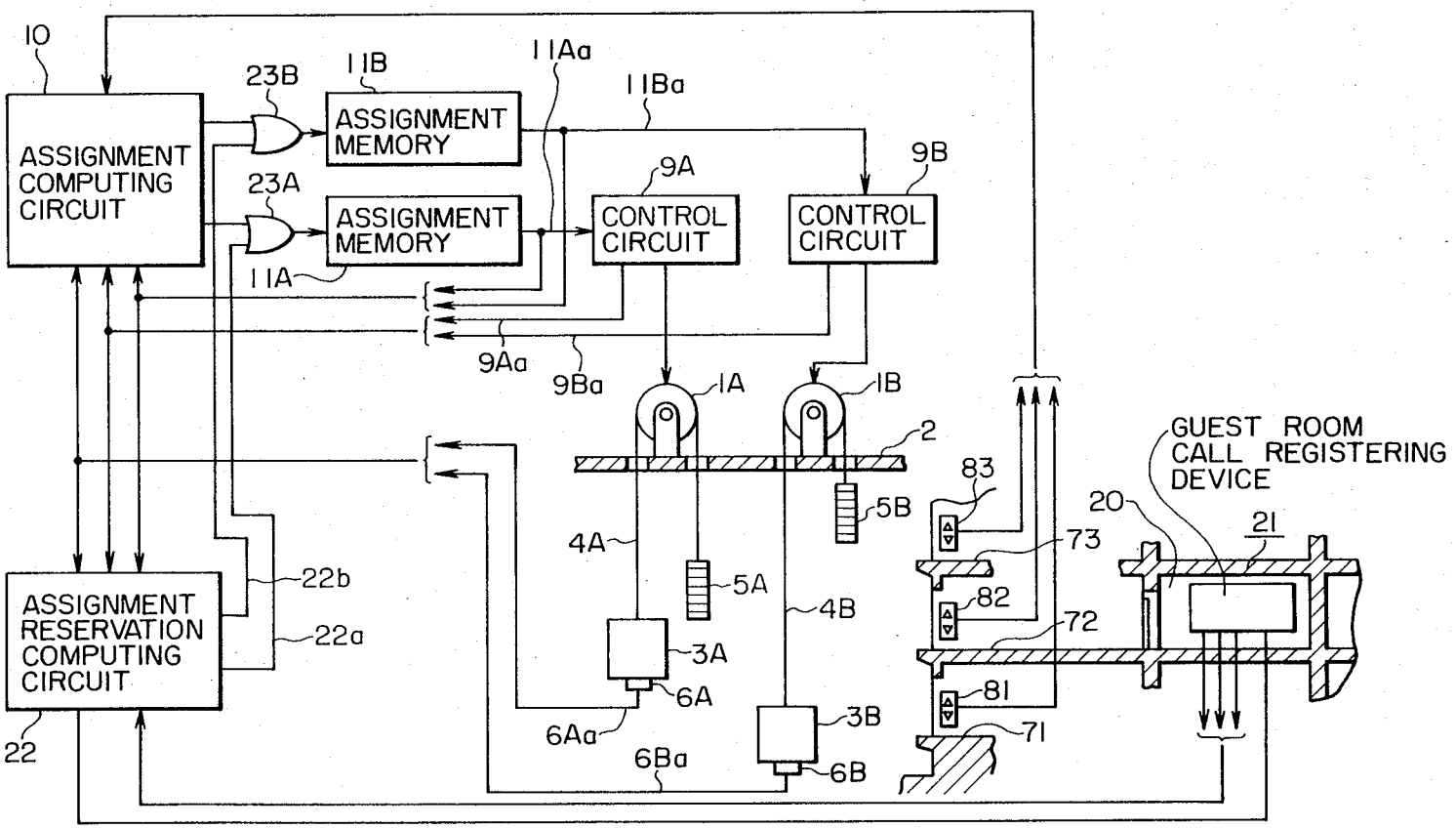
Figure 4:
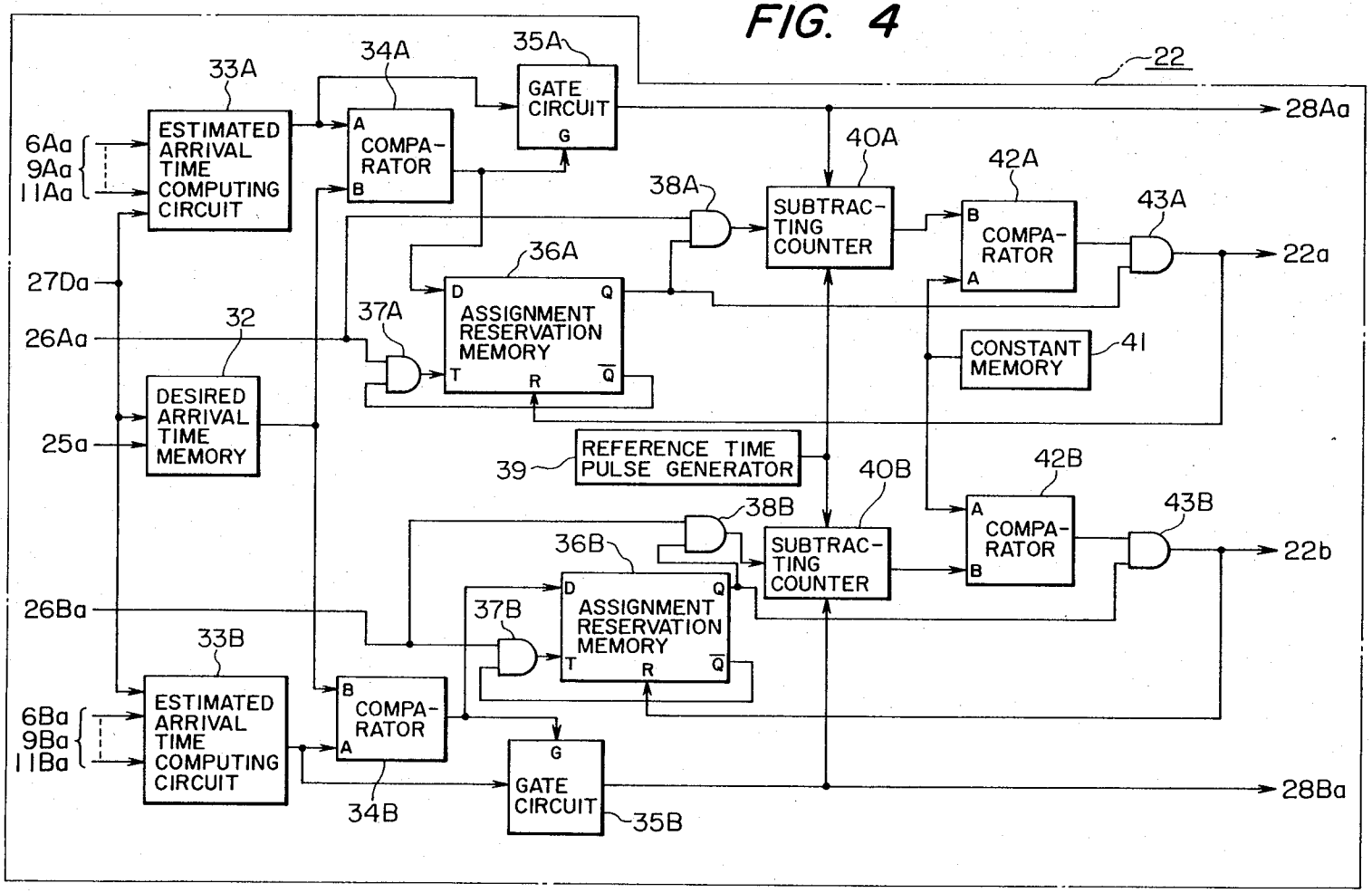

FIGS. 2 and 4 show a preferred embodiment of an elevator system of the present invention.

Figure 1:
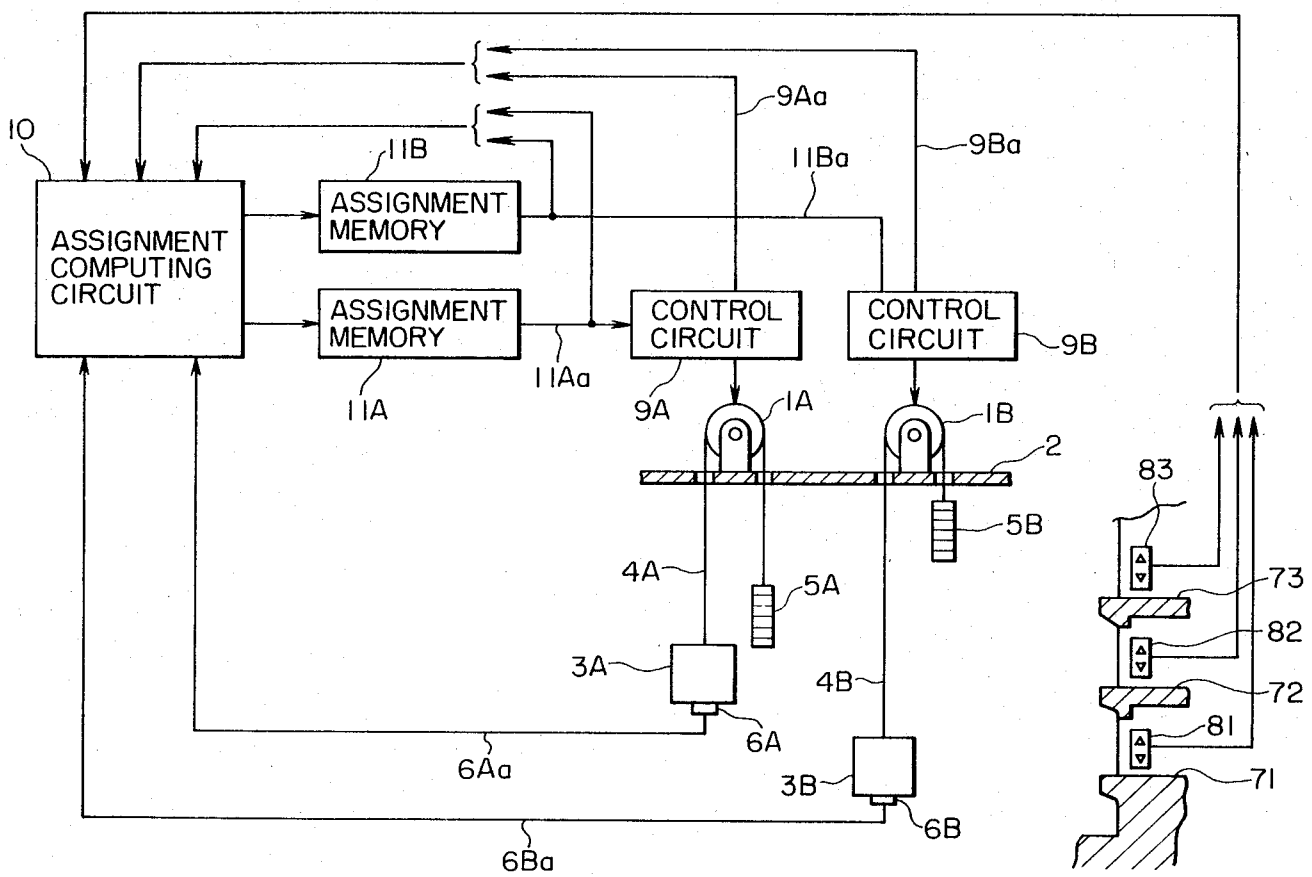
FIG. 1 PRIOR ART
FIG. 1 is a schematic block diagram showing a conventional elevator group control apparatus.
Figure 3:
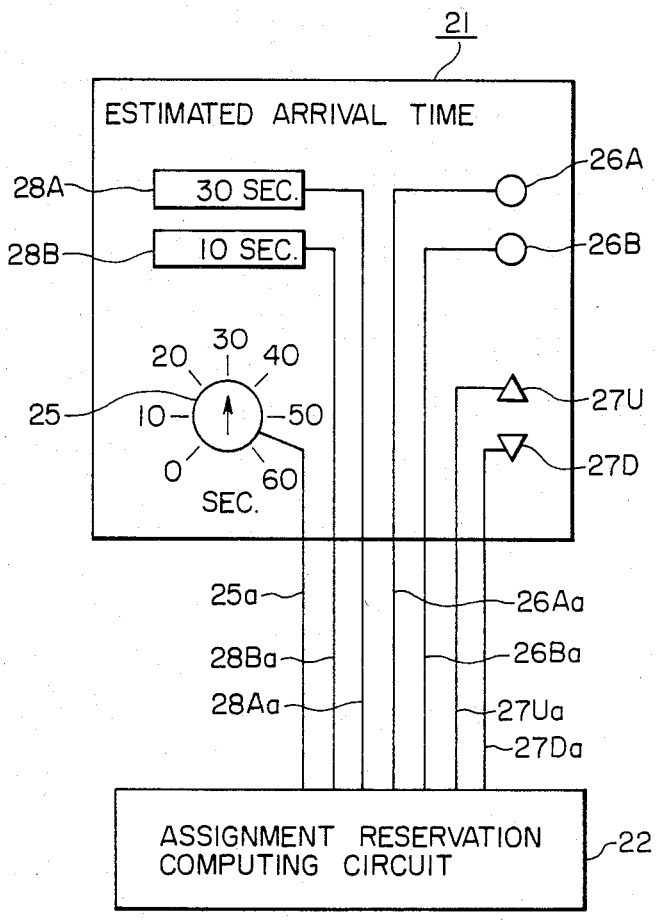

In FIG. 2, the same designations as those used in FIG. 1 indicate the same or corresponding parts, and hence further detailed descriptions thereof are omitted. Further in FIG. 2, reference numeral 20 designates a guest room located at some distance from the second floor elevator area 72, and 21 designates a room call registering device provided in the guest room 20. The details of the device 21 are shown in FIG. 3. Reference numeral 22 designates an assignment reservation computing circuit which determines the assignments of floor calls registered by the guest room call registering device 21 and produces assignment signals 22*a* and 22*b* after a proper lapse of time to cause the assignment memories 11A and 11B to store the signals 22*a* and 22*b*, respectively. Reference numeral 23A designates an OR gate of elevator A for ORing the output of the assignment computing circuit 10 and the output 22*a* of the assignment reservation computing circuit 22 to produce as ORed output for the assignment memory 11A. Similarly, 23B designates an OR gate for the elevator B.

FIG. 3 shows the details of the guest room call registering device 21, in which reference numeral 25 denotes a desired arrival time designation switch for designating the time required for any one of the cages 3A and 3B to arrive at the second floor 72 from the present time and for producing a signal 25*a* representing the designated desired arrival time. In the drawing, although the longest time available is 60 seconds, the invention is not limited to this value. Reference numeral 26A denotes an elevator A designation button for producing a signal 26A*a* representing the designation of elevator A, the signal 26A*a* being in the H (high) logic state upon the actuation of the button 26A. Similarly, reference numeral 26B denotes elevator B designation button which produces a B elevator designation signal 26B*a*. Reference numeral 27U denotes a guest-room up-call button for producing an up-call signal 27U*a*, which is in the H state upon the actuation of the button 27U, and 27D denotes a guest-room down-call for producing a down-call signal 27D*a*. Reference numeral 28A denotes an arrival time display device for indicating the time from the present time to the arrival of elevator A in response to elevator A arrival time signal 28A*a* produced by the assignment reservation computing circuit 22. Similarly to this, 28B denotes elevator B arrival time display device which provides a display in response to an elevator A arrival time signal 28B*a*.

FIG. 4 shows the details of the assignment reservation computing circuit 22, in which 32 denotes a desired arrival time memory for storing the up-call signal 27U*a*, the down-call signal 27U*b* (only the up-call signal 27U*a* is indicated in the drawing) and the desired arrival time signal 25*a* corresponding thereto; 33A, an estimated arrival time computing circuit, having a function equivalent to that shown in FIG. 7 of the above-mentioned U.S. Pat. No. 4,244,450, provided for computing the time required for the elevator A to respond to the up-call signal 27U*a* and the down-call signal 27D*a* in response to the elevator A passenger-number signal 6A*a*, the elevator A information signal 9A*a*, and the elevator A call signal 11A*a*; 33B, an estimated arrival time computing circuit, similar to the circuit 33A, for computing the time required for the elevator B to respond to the up-call signal 27U*a* and the down-call signal 27D*a* in response to the elevator A passenger-number signal 6B*a*, the elevator B information signal 9B*a*, and the elevator B call signal 11B*a*; and 34A, a comparator for the elevator A for comparing the estimated time signal indicated by the estimated arrival time computing circuit 33A with the desired arrival time signal from the desired arrival time memory 32 and producing an H-level signal when the estimated time is longer than the desired arrival time and producing in the contrary case an L-level (low level) signal. Reference numeral 34B denotes a comparator for the elevator B for comparing the estimated time indicated by the estimated arrival time computing circuit 33B with the desired arrival time signal from the desired arrival time memory 32 and producing an H-level signal when the estimated time is longer than the desired arrival time and producing in the contrary case an L-level signal. Reference numeral 35A denotes a gate circuit of the elevator A which is opened in response to the H-level signal of the comparator 34A so as to pass the estimated time signal from the estimated arrival time computing circuit 33A as the arrival time signal 28A*a* and, similarly, 35B denotes a gate circuit of the elevator B which is open in response to the H-level signal of the comparator 34B so as to pass the arrival time signal 28B*a*. Reference numeral 36A denotes an assignment reservation memory of the elevator A constituted by a D-type flip-flop having D, T and R terminals to which the output of the comparator 34A, the output of an AND gate 37A ANDing the elevator A designation signal 26A*a* and the output signal from the inverted output terminal $\overline{Q}$ of the flip-flop 36A, and the output 22*a* of the assignment reservation computing circuit 22 are respectively applied. Similar to this, 36B denotes an assignment reservation memory, and 37B an AND gate connected to the T terminal of the assignment reservation memory 36B. Reference numeral 38A denotes an AND gate of elevator A which produces an H-level signal when the elevator A designation signal 26A*a* is at the H-level and, at the same time, the noninverted output terminal Q of the assignment reservation memory 36A is an H-level signal; 38B, similar to 38A, is an AND gate of elevator B; 39, a reference timing pulse generator for producing an H-level signal pulse at a predetermined frequency; 40A, a decrementing (countdown) counter of elevator A which is initialized with the estimated time of the elevator A estimated arrival time computing circuit 33A when the AND gate 38A produces an H-level signal and produces an output count signal obtained by subtracting one from the stored estimated time every time the reference time pulse generator 39 produces a pulse; 40B, similar to 40A, a decrementing counter elevator B; 41, a constant memory which stores a constant value signal having a value corresponding to the time required for each of the elevators A and B, to travel from the time of initiation of deceleration from full speed to the time of stopping at the second floor; 42A, a comparator of elevator A for comparing the constant value signal inputted to the terminal A with the output signal of the counter 40A inputted to the terminal B to produce an H-level when the output signal of the counter 40A is smaller than constant value signal; 42B, similar to 42A, a comparator of elevator B; 43A, an AND gate of elevator A which produces the assignment signal 22*a* at the H-level when the output signal of the comparator 42A is an H-level signal and at the same time the noninverted output terminal Q of the assignment reservation memory 36A is also an H-level signal; and 43B, similar to 43A, an AND gate of elevator B.

In the elevator group control apparatus arranged as described above, the same operations as in the conventional apparatus shown in FIG. 1 are performed whenever any one or ones of the call buttons 81 through 83 are operated.

If the guest-room down-call button 27D of the guest-room call registering device 21 is operated, the down-call signal 27D*a* is produced. Assuming that the desired arrival time is designated as 20 seconds by operating the desired arrival time designating switch 25, the desired arrival time signal 25*a* is produced. The down-call signal 27D*a* is stored together with the desired arrival time signal 25*a* in the desired arrival time memory. The estimated arrival time required for elevator A to respond to the down-call signal 27D*a* is computed by the computing circuit 33A. The estimated arrival signal 28A*a* and the desired arrival time signal 25*a* are compared with each other by the comparator 34A. If the estimated arrival time signal 28A*a* is smaller than the desired arrival time signal 25*a*, the gate circuit 35A is not opened because the cage 3A may arrive at the second floor before the user reaches the second floor elevator area. If the estimated arrival time signal 28A*a* is larger than the desired arrival time signal 25*a*, the contrary, the comparator 34A produces an H-level signal so that the gate circuit 35A is opened and the estimated arrival time is displayed on the arrival time display device 28A in the guest room 20. Similar to this, with regard to elevator B, the estimated arrival time signal 28B*a* is produced from the estimated arrival time computing circuit 33B and displayed on the arrival time display device 28B through the gate circuit 35B. The user may determine which one of the elevators A and B he or she wishes in view of the values indicated by the display devices.

Assuming now that the elevator A designation button 26A has been depressed, the elevator A designation signal 26A*a* is inputted to the AND gate 37A. Since the guest-room call registering device 21 had not been actuated before the guest-room down-call button was last operated, the terminal Q and $\overline{Q}$ of the assignment reservation memory 36A are at L and H levels, respectively. Accordingly, the AND gate 37A produces an H-level signal so that the terminals Q and $\overline{Q}$ of the assignment reservation memory 36A continue to produce L- and H-level signals, respectively, in response to the H-level signal from the comparator 34A. The AND gate 38A produces an H-level signal in response to the H-level signal at the Q terminal of the assignment reservation memory 36A to thereby actuate the counter 40A. By actuation of the counter 40A, the estimated arrival time signal 28A*a* is decremented by one every time the reference time pulse generator 39 produces a pulse. The decremented signal is successively compared with the constant value signal of the constant memory 41 by the comparator 42A, which produces an H-level signal as soon as the decremented signal becomes smaller than the constant value signal of the constant memory 41 as detected by the comparator 42A, which produces an H-level signal as soon as the decremented signal becomes smaller than the constant value signal. At that time the assignment signal 22*a* produced by the AND gate 43A becomes an H-level signal in response to the H-level signal from the comparator 42A. This assignment signal 22*a* resets the assignment reservation memory 36*a* and in stored in the assignment memory 11A, whereupon the cage 3A serves the second floor in the same manner as in the conventional example discussed with reference to FIG. 1.

In the case where the guest-room up-call button 27U is operated, the apparatus functions similarly to the case of the actuation of the room down-call button 27D as described above.

In the case where the elevator B designation button 26B is operated, the estimated arrival time computing circuit 33B, the comparator 34B, the gate circuit 35B, the assignment reservation memory 36B, the AND gate 37B, the AND gate 38B, the counter 40B, the comparator 42B, the AND gate 43B, the OR gate 23B, and the assignment memory 11B operate similarly to the case where the guest-room down-call button 27D is actuated as described above.

According to the embodiment as described above, the guest-room up-call button 27U and the guest-room down-call button 27D are provided in the guest-room 20. When a floor call is generated with these buttons, the estimated arrival time required for each cage to respond to the call is computed and compared with the desired arrival designated by the user with the desired arrival time designating switch, the assignment of the call is given to one of the elevators on the basis of the comparison result. Accordingly, if the user arrives at the second floor (72) elevator area within the designated desired arrival time, one of the cages 3A and 3B will arrive with a timing such that the user is not made to wait as long as he or she would have had to wait had the call been made at the time of arrival at the second floor elevator area.

Particularly, since when a guest-room call is initiated, the assignment is first held in a state of reservation and the transition from the state of reservation to the state of actual (irrevocable) assignment is delayed as long as possible within the range of time required for the cage 3A and 3B to respond to the call in question, a call generated by the hall call button is assigned normally, even in the case where the desired arrival time with respect to the guest-room call is lengthened, thereby preventing an increase in arrival time to hall calls due to guest-room calls.

Although a preferred embodiment has been described above where only one guest-room registering device is provided, in the case where a plurality of such guest-room call registering devices are provided, a plurality of assignment reservation computing circuits, one of which is shown in FIG. 4, are required, one for each guest-room call registering device.

Further, although in the described embodiment the reservation assignment memories 36A and 36B are set by the elevator-number designation switch, it is possible to automatically assign a cage for which the estimated arrival time is longer than but closest to the desired arrival time requested by the user, thereby making it possible to eliminate the designation switch.

Further, although a constant value is set in the constant memory 41 and the assignment signal 22*a*/22*b* is generated when the content of the decrementing counter 40A/40B becomes lower than the constant value, it is possible to freely set in the memory 41 a value suitable to group control, taking the elevator velocity, the floor height, etc., into consideration. Furthermore, the input to each of the estimated arrival time computing circuits 33A, 33B, etc., is indicated by a single signal line in the described embodiment, but it is a matter or course that a plurality of signal lines may be required depending on the data format employed.

Figure 5:
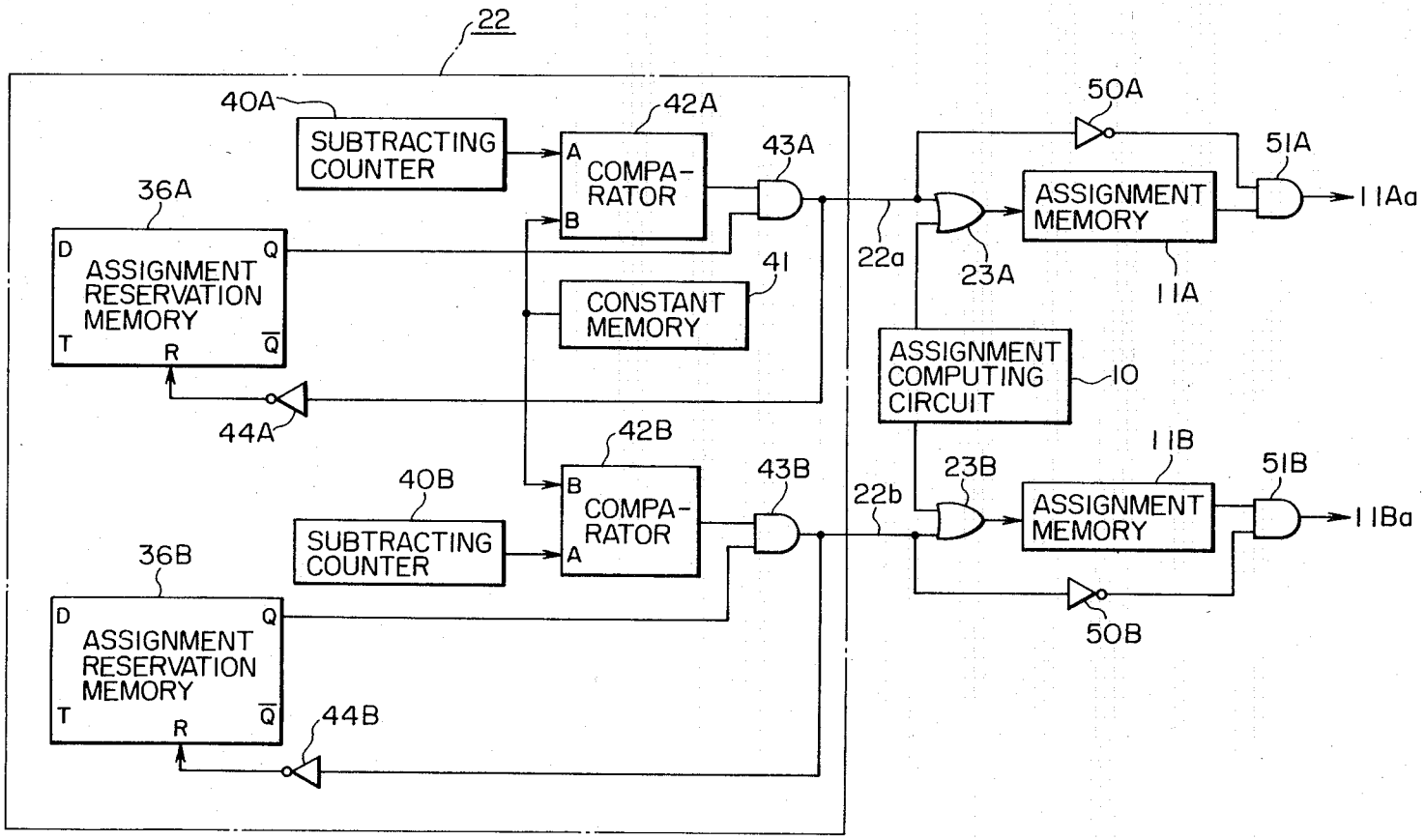
FIG. 5 is a circuit diagram showing a main part of another embodiment of the present invention.

FIG. 5 shows another embodiment of the present invention, in which 44A, 44B, 50A and 50B denote inverters, and 51A and 51B denote AND gates. Decrementing counters 40A and 40B are connected to the respective terminals A of the comparators 42A and 42B, and a constant memory 41 is connected to the terminal B of each of the comparators 42A and 42B in a manner opposite to that shown in FIG. 4. Thus, the respective outputs of the comparators 42A and 42B are H-level signals when the contents of the counters 40A and 40B are larger than the content of the constant memory 41.

The arrangement other than that shown in the drawing is the same as for the case of FIG. 4.

Assuming now that the user's desired arrival time is 20 seconds, that the estimated arrival time of elevator A and the estimated arrival time of elevator B are 30 seconds and 10 seconds, respectively, that the content of the constant memory 41 is a value corresponding to 10 seconds, that the assignment reservation memory 36A of elevator A is set, and that at the same time the counter 40A is initialized to a value corresponding to 30 seconds, the output of the comparator 42A will be an H-level signal and the Q output terminal of the assignment reservation memory 36A is also an H-level signal. Then, the assignment signal 22*a* is at the H-level, thereby setting the assignment memory 11A. Since the inverted assignment signal 22*a* is applied to one input of the AND gate 51A, an L-level signal is inputted to one input of the AND gate 51A when the assignment signal 22*a* is an H-level signal and the assignment call signal 11A*a* is set to the L-level.

When the content of the subtracting counter 40A becomes smaller than the content of the constant memory 41 and the output of the comparator 42A becomes an L-level signal, the assignment signal 22*a* also becomes an L-level signal and the assignment call signal 11A*a* becomes an H-level signal. At the same time, the assignment reservation memory 36A is reset to enable reservation be made. The assignment memory 11A is maintained in the set state before a response has been performed by elevator, even if the assignment signal changes to the L-level.

That is, although the assignment memory 11A is set at the same time the assignment reservation memory 36A is set, the assignment call signal 11A*a* will be produced after a lapse of time of 20 seconds (30 sec−20 sec=10 sec). On the other hand, if any one of the hall call buttons 81 through 83 is operated and the assignment signal at the H-level is produced by the assignment computing circuit 10, the assignment call signal 11A*a* is produced at the same time as the assignment memory 11A or 11B is set when the assignment signal 22*a* or 22*b* is at the L-level, so that the response to the hall call buttons 81 through 83 is not delayed.

According to the present invention, in an elevator group control apparatus in which a first call signal is generated by a first call device provided at each of a plurality of elevator hall areas served by a plurality of elevator cages, in which an assignment computing circuit is actuated by the first call signal to select one of the cages in a predetermined manner to thereby assign the first call to the selected cage, and in which a signal representing the assignment is stored in assignment memories respectively provided for the cages to thereby cause a selected cage to perform the requested service, a second call device is provided separately from the first call device. A desired time required for the cage to respond to a second call signal generated by operating the second call button is designated by a desired arrival time designating device, and an estimated arrival time required for the cage to respond to the second call is computed by an estimated arrival time computing circuit. A cage for performing the requested service is selected by a selecting device on the basis of the results of comparison between the estimated arrival time and the desired time, and the second call signal is stored in the assignment memory of the selected cage so as to be served. It is thereby made possible by the second call device to cause a cage to make a response at the user's desired time.

I claim:

1. In an elevator group control apparatus in which a call signal is generated by a first call means provided at each of a plurality of floors served by a plurality of cages, an assignment computing circuit is actuated by said first call signal to select one of said cages in a predetermined manner to thereby assign said first call signal to said selected cage, a signal representing the assignment is stored in assignment memories respectively provided for said cages to thereby cause said selected cage to perform service, the improvement comprising:

(a) second call means provided separately from said first call means for producing a second call signal and a desired arrival time designation signal for designating a desired time for a cage to make service in response to the second call signal; and (b) assignment means receiving said second call signal and said desired arrival time designation signal for determining how service is to be performed, said assignment means comprising means for computing estimated arrival times required for each of said cages to respond to said second call signal, means for comparing the computed estimated arrival times with said desired time to thereby perform said selecting operation, and means for transmitting an assignment signal obtained as a result of comparison to corresponding ones of said memories;

wherein said assignment means comprises means for selecting one of said cages for which said estimated arrival time is longer than and closest to said desired time thereof so that the first call signal takes priority over the second call signal.

2. The elevator group control apparatus according to claim 1, wherein said assignment means transmits said assignment signal to said corresponding memory with a delay corresponding to said estimated arrival time.

3. The elevator group control apparatus according to claim 1, wherein said second call means is provided at a position separated from an elevator area of each floor.

4. The elevator group control apparatus according to claim 1, wherein each of said assignment memories is supplied with respective assignment signals from both of said assignment computing circuit and said assignment means and stores said assignment signals therein so as to cause the cages corresponding to said stored assignment signals to make service accordingly.

5. The elevator group control apparatus according to claim 1, wherein said second call means comprises an up-call/down-call button, and said second call means comprises means for transmitting a call signal generated by said button.

6. The elevator group control apparatus according to claim 1, wherein said second call means comprises desired arrival time designation means for designating the time required for arrival of a cage, and means for transmitting the designated desired arrival time to said assignment means.

7. The elevator group control apparatus according to claim 1, wherein said second call means comprises cage designation means for designating a desired one of said cages and means for transmitting a cage designation signal to said assignment means.

8. The elevator group control apparatus according to claim 1, wherein said second call means comprises estimated arrival time display means for displaying an estimated arrival signal computed by said assignment means.

9. In an elevator group control apparatus in which a call signal is generated by a first call means provided at each of a plurality of floors served by a plurality of cages, an assignment computing circuit is actuated by said first call signal to select one of said cages in a predetermined manner to thereby assign said first call signal to said selected cage, a signal representing the assignment is stored in assignment memories respectively provided for said cages to thereby cause said selected cage to perform service, the improvement comprising:

(a) second call means provided separately from said first call means for producing a second call signal and a desired arrival time designation signal for designating a desired time for a cage to make service in response to the second call signal; and (b) assignment means receiving said second call signal and said desired arrival time designation signal for determining how service is to be performed, said assignment means comprising means for computing estimated arrival times required for each of said cages to respond to said second call signal, means for comparing the computed estimated arrival times with said desired time to thereby perform said selecting operation, and means for transmitting an assignment signal obtained as a result of comparison to corresponding ones of said memories;

(c) wherein said assignment means comprises: estimated arrival time computing means for computing said estimated arrival time for each of said cages in response to said second call signal; a desired arrival time memory for storing said desired arrival time designation signal; a first comparator provided for each of cages for comparing the estimated arrival time inputted from said estimated arrival time computing means and the desired arrival time inputted from said desired arrival time memory and producing an output signal when said estimated arrival time is longer than said desired arrival time; and an assignment reservation memory for storing assignments in response to said output of said first comparator.

10. The elevator group control apparatus according to claim 9, wherein said assignment means supplies a signal representing the estimated arrival time of said estimated arrival time computing means to said second call means in response to said output signal of said first comparator to cause said second call means to display said estimated arrival time.

11. The elevator group control apparatus according to claim 9, wherein said assignment means further comprises: a counter for storing a signal representing the estimated arrival time from said estimated arrival time computing means when said first comparator produces said output signal and for reducing said estimated arrival time every reference time to thereby produce an output; a second comparator for comparing said output of said counter and a value representing the time required for each cage from initiation of deceleration from the state of full-speed to stopping at the floor at which said second call has been generated so as to produce an output signal when the output of said counter becomes smaller than said value representing said time, whereby, when both of said first and second comparators produce active-state output signals, the assignment signal is transmitted to said assignment memory.

12. The elevator group control apparatus according to claim 9, wherein an up-call or down-call signal generated by said second call means is stored in said desired arrival time memory.

* * * * *